US005460937A

United States Patent [19]

Blease et al.

[11] Patent Number: 5,460,937

[45] Date of Patent: Oct. 24, 1995

[54] PROCESS FOR INCORPORATING A HYDROPHOBIC COMPOUND INTO AN AQUEOUS MEDIUM

[75] Inventors: James W. Blease, Rochester; John W. Boettcher, Webster, both of N.Y.

[73] Assignee: Eastman Kodak Company, Rochester, N.Y.

[21] Appl. No.: 301,826

[22] Filed: Sep. 7, 1994

Related U.S. Application Data

[63] Continuation-in-part of Ser. No. 139,379, Oct. 20, 1993, abandoned, and a continuation-in-part of Ser. No. 139,380, Oct. 20, 1993, abandoned.

[51] Int. Cl.[6] ..... G03C 1/015

[52] U.S. Cl. ..... 430/569; 430/546; 430/631; 430/583; 430/584; 430/588

[58] Field of Search ..... 430/546, 631, 430/569, 583, 584, 588

[56] References Cited

U.S. PATENT DOCUMENTS

| | | | |
|---|---|---|---|
| 3,676,147 | 7/1976 | Boyer et al. | 430/569 |
| 4,140,530 | 2/1979 | Trunley et al. | 430/569 |
| 4,146,399 | 3/1979 | Trunley et al. | 430/569 |
| 4,193,801 | 3/1980 | Hopwood et al. | 430/570 |
| 5,096,492 | 3/1992 | Fuisz | 106/215 |

FOREIGN PATENT DOCUMENTS

| | | | |
|---|---|---|---|
| 468389 | 7/1991 | European Pat. Off. . | |
| 472007 | 2/1992 | European Pat. Off. . | |
| 1563133 | 7/1976 | United Kingdom | 430/377 |

*Primary Examiner*—Charles L. Bowers, Jr.
*Assistant Examiner*—Mark F. Huff
*Attorney, Agent, or Firm*—Andrew J. Anderson

[57] ABSTRACT

Hydrophobic compounds, such as photographically useful compounds, are incorporated into an aqueous medium, such as a silver halide emulsion or a photographic coating composition, by forming a solid additive material comprising the hydrophobic compound and a solid hydrophilic material. The solid hydrophilic material is preferably a mixture of a polysaccharide and sorbitol or succinimide. The additive material is prepared by dry powder mixing the solid hydrophobic compound and solid hydrophilic material followed by a process step that heats, expells, and cools the composition to produce a high surface area uniform material having a specific surface area of at least about 10 square centimeters per gram. The additive material can then be dissolved directly and uniformly in the aqueous medium.

26 Claims, No Drawings

PROCESS FOR INCORPORATING A HYDROPHOBIC COMPOUND INTO AN AQUEOUS MEDIUM

CROSS-REFERENCE TO RELATED APPLICATIONS

This application is a continuation-in-part of commonly assigned U.S. Ser. Nos. 08/139,379 and 08/139,380, both filed Oct. 20, 1993, and both now abandoned, the disclosures of which are incorporated by reference.

FIELD OF THE INVENTION

This invention relates to a method of incorporating a hydrophobic compound into an aqueous medium. More particularly, it relates to a method of incorporating a hydrophobic, photographically useful compound into a photographic composition, such as a silver halide emulsion or a coating composition, and to a photographic element having at least one layer comprising said composition.

BACKGROUND INFORMATION

In the preparation of photographic compositions, such as silver halide emulsions and coating compositions, which are aqueous systems, it is often desirable to add essentially water-insoluble, hydrophobic, photographically useful compounds (such as spectral sensitizing dyes and the like) to produce the desired photographic characteristics. One well known method to incorporate these hydrophobic compounds is to prepare a solution of the compound in a volatile, water miscible organic solvent and subsequently adding the solution to the emulsion or coating composition. Typically these solvents are methanol, ethanol, n-propanol, acetone, and the like. However, it is also generally recognized that use of these solvents can have several adverse consequences, specifically:

1. evaporation during handling can cause changes in concentration;
2. the solvents can interact with other components to form solid particles leading to coating defects;
3. use of these solvent requires extra expense to provide worker safety (from vapors and splashing); and
4. the solvents are evaporated during coating and represent an organic vapor emission, which can be undesirable.

Others have recognized these problems and have attempted various methods of eliminating volatile organic solvent solutions as an incorporation method. However each of the methods developed to date have significant problems associated with them as described below.

Boyer and Caridi in U.S. Pat. No. 3,676,146 disclose a process of dispersing spectral sensitizing dye in a water soluble organic liquid and subsequently adding the mixture to a silver halide emulsion. Prior to addition to the emulsion, the dye-solvent dispersion can be added to a gelatin solution. This process requires preparation of a slurry or dispersion (by ball milling) then subsequent addition of a gelatin solution and then drying. This is a relatively complicated process that can result in significant process time and materials losses especially when compared with the current practice of preparing a volatile organic solvent solution described above.

In U.S. Pat. No. 4,140,530, Trunley and Hopwood disclose a process of creating a solid additive mixture containing a hydrophobic photographic compound. The mixture is prepared by mixing the hydrophobic compound with a water soluble organic powder then adding a hydrophilic binder solution (such as gelatin) and, optionally, a solid wetting agent to form a paste. Noodles are then created from the paste and then dried. After removing water in the drying step, the solid noodles are added to the silver halide emulsion or coating composition. In a similar process, U.S. Pat. No. 4,146,399 describes adding another process step to compress the noodles into uniform tablets. Relative to the current practice of preparing an organic solvent solution, the processes described in U.S. Pat. Nos. 4,140,530 and 4,146,399 require numerous process steps which invariably cause additive waste and complicate the manufacturing process. In addition, in U.S. Pat. No. 4,146,399, addition of an amount of material other than unit tablet quantities would be inconvenient.

Trunley and Hopwood also disclose in U.K. Patent No. 1,563,133 a process of creating a solid additive mixture by first melting a water soluble organic compound and either dissolving or dispersing the photographic additive in the molten organic compound. The mixture is then cooled and solidified. The solid mixture is then ground to a fine powder and added to the silver halide emulsion or coating composition. Grinding the mixture adds another process step (where physical losses can occur) and creates the problem of powder dusting when the mixture is added to the liquid emulsions or coating compositions.

In European Patent Application 468 389 A1, Mason describes a process of placing a hydrophobic photographic additive as a powder in a gelatin capsule in an effort to avoid the problems of powder dusting. The gelatin capsule is then added to the silver halide emulsion or coating composition. This method, although overcoming the potential powder dusting problem disclosed in U.K. Patent 1,563,133, does make addition of additive quantities intermediate between the unit capsule quantities difficult, especially if the non-capsuled photographic additive does not wet and disperse well after addition to the emulsion or coating composition surface.

In U.S. Pat. No. 5,096,492 to Fuisz, a method of dispersing an oleaginous substance in aqueous medium is disclosed. In the method of Fuisz, the oleaginous substance is mixed with a saccharide, such as sucrose, and the resulting mixture is melt spun in a cotton candy spinning machine or the equivalent. The resulting product disposes autogeneously in water to form a colloidal-like dispersion. It has been found that certain hydrophobic compounds and certain mixtures of hydrophilic compounds and hydrophobic compounds require higher temperatures and/or longer residence times in the melt spinning machine which can lead to oxidation or burning of the material. Also, when certain hydrophobic compounds are used in the Fuisz method a non-uniform dispersion is obtained. We believe this to be due to inadequate dissolution or dispersal of the hydrophobic compound in the saccharide.

PROBLEM TO BE SOLVED BY THE INVENTION

This invention eliminates the problems described above and also eliminates the problems associated with the use of volatile organic solvents. Only one additional process step is required in the practice of-this invention compared with preparing organic solvent solutions and this is several steps less than the methods described above.

SUMMARY OF THE INVENTION

One aspect of this invention comprises a method for incorporating a solid, hydrophobic, photographically useful compound into an aqueous photographic composition which comprises:

(a) mixing particles of the photographically useful compound with particles of a hydrophilic solid material;

(b) heating the resulting mixture in a primary processing device to at least the softening point of the mixture, and expelling the heated mixture directly from the primary processing device to rapidly cool the mixture and to thereby directly form a solid additive material having a specific surface area of at least about 10 square centimeters per gram; and (c) adding the solid additive material directly into the aqueous photographic composition. In the method of this aspect of the invention, step (b) is preferably carried out in an extruder or melt spinning device.

Another aspect of this invention comprises a photographic element comprising a support having coated on a surface thereof at least one layer comprising a composition containing a hydrophobic photographically useful compound incorporated into the composition by the above method.

A further aspect of this invention comprises a method for incorporating a solid, hydrophobic compound into an aqueous medium which comprises:

(a) mixing particles of the hydrophobic compound with particles of a hydrophilic solid material comprising a mixture of water soluble polymer and a water soluble low molecular weight compound having a melting point between about 30° C. to about 200° C.;

(b) heating the resulting mixture in a primary processing device to at least the softening point of the mixture, and expelling the heated mixture directly from the primary processing device to rapidly cool the mixture and to thereby directly form a solid additive material having a specific surface area of at least about 10 square centimeters per gram; and (c) adding the solid additive material directly into the aqueous medium. In the method of this aspect of the invention, step (b) is preferably carried out in an extruder or melt spinning device.

ADVANTAGEOUS EFFECT OF THE INVENTION

This invention creates a high surface area solid additive material comprising a hydrophobic compound, such as a hydrophobic photographically useful compound, and a hydrophilic solid material. When added to aqueous media, such as photographic silver halide emulsions or coating compositions, the solid additive material wets and disperses the hydrophobic compound uniformly throughout the aqueous media. Further, dusting is not a problem when the solid additive material is added to the aqueous system.

DETAILED DESCRIPTION OF THE INVENTION

In the present invention, a hydrophobic compound is added to aqueous medium. The term "hydrophobic" is used herein to mean that the compound has a water solubility of less than or equal to about 1% by weight at 25° C. In accordance with one aspect of the invention, the hydrophobic compound is a photographically useful compound and the aqueous medium comprises an aqueous photographic composition or silver halide emulsion. Silver halide emulsions comprise silver halide grains dispersed in an aqueous medium. The aqueous medium preferably contains a hydrophilic colloid such as gelatin. The silver halide grains can be silver chloride, silver bromide, silver iodide, or mixed halide crystals such as silver chlorobromide, silver chloroiodide or the like. The morphology of the grains is not critical and can de cubic, octahedral, tabular or the like. Silver halide emulsions are well known in the photographic art and such emulsions can be prepared by methods, such as those described in Research Disclosure 308119 (December 1989), the disclosure of which is incorporated herein by reference. Suitable silver halide emulsions are described more fully below.

Photographic coating compositions are aqueous based systems which contain a hydrophilic colloid, preferably gelatin, and generally one or more photographically useful compounds, such as couplers, absorbing dyes, scavengers and the like.

The photographically useful compound incorporated into a photographic emulsion or coating composition in accordance with one aspect of this invention, may function by adsorption to the surface of the silver halide grain or by being uniformly dissolved or dispersed in the aqueous system. Such photographically useful compounds include compounds from the following classes: spectral sensitizing dyes, absorbing dyes, antifoggants, antioxidants, nucleating agents, biostats, biocides, antifoamants, development accelerators, emulsion finish modifiers, image toners, optical brighteners, couplers, antistain agents, hardeners, storage stabilizers, and latent image stabilizers. Mixtures of two or more photographically useful compounds can be incorporated in a photographic composition in accordance with this invention. Preferred photographically useful compounds are described more fully below.

In accordance with the invention, particles of the hydrophobic compound are admixed with particles of a hydrophilic solid material. The term "hydrophilic" is used herein to mean a material that has a water solubility of greater than or equal to about 5% by weight at 25° C. In accordance with one aspect of this invention, the hydrophilic solid material comprises a water soluble polymer and a water soluble low molecular weight compound having a melting point between about 30° C. and about 200° C. The ratio of hydrophobic compound to hydrophilic solid material is preferably from about 0.1:99.9 to about 80:20, more preferably about 0.1:99.9 to about 10:90, and most preferably about 0.5:99.5 to about 5:95.

The hydrophilic solid material preferably comprises a water soluble polymer. Illustrative water soluble polymer classes that can be used, singly or in combination, with the hydrophobic compounds to form the additive material include, for example: polysaccharide, polyvinyl alcohol, polyacrylamide, cellulose derivatives (such as hydroxyethyl cellulose, hydroxypropyl cellulose, methyl cellulose, or the like), polyoxyethylene, gelatin, vegetable gum (such as guar gum, carageenan, and the like), polyacrylic acid, polyvinyl pyrrolidone, partially hydrolzed polyvinyl acetate, and derivatives or copolymers (such as block copolymers or graft copolymers) of these. Particularly preferred are polysaccharides, such as maltodextrin.

Additionally, these water soluble polymers may be plasticized for processing by the addition of small amounts of water and/or a water soluble organic solvent (such as 1,2-propanediol, triethyl citrate, polyethylene glycol having a molecular weight of less than 1000, or the like). The plasticizer may be used in an amount of up to about 25% by weight, based on the weight of water soluble polymer.

In accordance with one aspect of the invention, in addition to a water soluble polymer, the hydrophilic solid material further comprises a water soluble low molecular weight compound which has a melting point between about 30° C.

and 200° C. The molecular weight of the compound is less than about 5000, preferably less than 2000. The ratio of water soluble polymer to the low molecular weight compound is preferably from 99:1 to 50:50. The presence of such low molecular weight compounds has been found to advantageously increase the useful processing rates through the primary processing device, and also to prevent discoloration caused by decomposition of certain water soluble polymers. Such compounds also help prevent discoloration and decomposition of the hydrophobic compounds, which may otherwise render them non-effective with regard to their intended function in the final aqueous medium. Use of these low molecular weight compounds is especially advantageous as potential decomposition products may be variable and difficult to control, and may have undesirable photographic effects. The low molecular weight compound preferably is selected from:

(a) derivatives, particularly alkyl derivatives, of urea and thiourea, preferably those of the formula

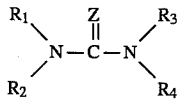

wherein $R_1$, $R_2$, $R_3$ and $R_4$ each independently represent alkyl having 1 to 4 carbon atoms, optionally substituted by hydroxyl, cycloalkyl or phenyl; tolyl, which is optionally substituted with OH- groups; and wherein $R_1$, $R_2$ and $R_3$ can also be hydrogen; and Z represents oxygen or sulphur. The following examples may be given: N-ethylurea, N-butylurea; N-(3-tolyl)-urea, N,N', - N,N'-ethyleneurea, N-methylthiourea, N,N'-dimethylthiourea, N-ethyl-N-phenylurea and N-hydroxymethylurea.

(b) saturated and unsaturated mono- and dicarboxylic acid amides, particularly those of formula $R—CO—NH_2$ or $R—(CONH_2)_2$ wherein R represents an alkyl or alkylene radical having 1 to 6 carbon atoms, or the group —CH=CH—, $CH_2$=CH— or $CH_3CH$=CH—, also phenyl or tolyl, also heterocyclic saturated and/or unsaturated 5- or 6-membered ring having at least one N, O, S, CO or NH in the ring, whereby the symbol R can optionally be substituted also by OH, $NH_2$, halogen or hydroxyalkyl having 1 to 3 carbon atoms. The acid amides are, for example, acetamide, chloroacetamide, nicotinic acid amide and benzamide.

(c) lactams such as d-valerolactam, e-caprolactam and oenantholactam;

(d) acid imides or derivatives of acid imides, especially those of the general formula

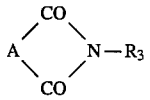

wherein A represent —CH=CH— or $(CH_2)_n$, wherein n is 1 to 6, and A can optionally be substituted by OH, $NH_2$, halogen, hydroxyalkyl ($C_1$—$C_3$), examples of these are: succinimide, maleinimide and N-hydroxysuccinimide;

(e) oximes such as acetoneoxime, cyclohexanoneoxime and diacetylmonoxime;

(f) saturated and unsaturated 5- or 6-membered heterocyclic compounds which contain in the ring O, S, CO and NH, and which can optionally be substituted with OH, $NH_2$, halogen, alkyl ($C_1$—$C_3$) groups, such as symmetrical trioxane, imidazole, 2-methyl-imidazole, pyrazole, pyrazine, 2,3-dimethyl-1-phenyl-5-pyrazolone, and 1,2,4-triazole;

(g) aliphatic or aromatic, polyvalent alcohols, such as 2,2-dimethyl- and 2,2-diethylpropanediol-1,3; dihydroxyacetone, o-xylylene glycol, erythrite, D-fructose, maltose, xylite, sorbitol and mannitol;

(h) polyalkylene glycols, such as polyethylene glycol preferably having a molecular weight of 1,000 to 20,000, especially those of the formula

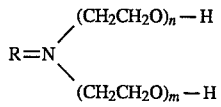

wherein R represents a saturated or unsaturated alkyl radical having 9 to 30 carbon atoms, and n and m each represents the numbers 3 to 200;

(i) carbamic acid esters, such as carbamic acid methyl ester, carbamic acid ethyl ester and carbamic acid propyl ester.

(j) derivatives of benzene, particularly those of the general formula

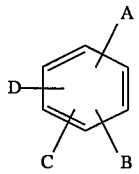

wherein A, B, C and D each independently represent OH, halogen, alkyl, hydroxyalkyl and alkoxy having 1 to 3 carbon atoms; and wherein A, B and C can be hydrogen; the following may for example be mentioned; 1,4-dihyroxybenzene 2,6-dihydroxytoluene, 2,3-dihydroxytoluene, 2,4-dimethyl-1,5-dihydroxybenzene, 4,5-dimethyl1,2-dihydroxybenzene, 3,5-dimethyl-1,2-dihydroxybenzene, 1,2-bis-(hydroxymethyl)-benzene, 1,3-bis(hydroxymethyl)-benzene, 1,4-bis-(hydroxymethyl)-benzene, 2-chloro-1,4-dihydroxybenzene, 4-chloro-1,2-dihydroxybenzene, 1-chloro-2,4,-dihydroxybenzene, 1-chloro-3,5-dihydroxybenzene, 1-chloro-2-5-dimethyl-1,4-hydroxybenzene and 1-chloro-4,5-dimethyl-2-hydroxybenzene.

Preferably, the low molecular weight compound is an acid imide of (d) on an aliphatic polyhydric alcohol of (g).

Particularly preferred is succinimide or sorbitol. Both of these compounds are very water soluble, sorbitol having a solubility 830 g/liter at 20° C.

To prepare the additive material, the hydrophobic compound and hydrophilic solid material are combined and mixed until homogeneous preferably using any commercially available powder mixers, blenders or mullers (such as those made by Gemco, American Process System, Paul 0. Abbe, National Engineering Co./Simpson, J. H. Day, Teledyne-Readco, Forberg, etc.) or small quantities can be mixed using a mortar and pestle. This, the resulting mixture, is then added to a primary processing device, such as a single or twin screw extruder or floss spinning machine such as those used in the manufacture of fiberglass or floss candy. Typical floss spinning machines described in U.S. Pat. Nos. 3,019,7456 to DuBois et al, 3,073,262 to Bowe, 3,557,717 to Chivers. Floss spinning machines are commercially available, for example, Econofloss® Model 3017 manufactured by Gold Medal Products Company of Cincinnati, Ohio.

The mixture can be added through a volumetric or gravimetric powder feeder (examples include feeders made by KTron, AccuRate, Thayer, etc.) that regulates the flow of the mixture to the primary processing device. In the primary processing device the temperature of the mixture is raised at least to the softening point of the mixture (glass transition temperature, Tg) and preferably up to or beyond the melting temperature of the polymeric compound in the mixture but below the decomposition temperatures of the polymers and hydrophobic compounds. Preferred temperatures range from about 40° C. to about 250° C., more preferably from about 70° C. to about 200° C. and most preferably from about 100° C. to about 180° C.

The mixture is preferably maintained at elevated temperature from about 0.1 second to about 5 minutes if the process device is a melt spinning device and from about 30 seconds to about 10 minutes if the process device is an extruder. In addition, the primary process device includes a mechanism for transporting and expelling the mixture once heated, for example the screw of the extruder. In selecting a device to heat the mixture containing the hydrophobic compound, consideration must be made for the expected residence time of the mixture in the device and the thermal stability of the ingredients. Once the mixture is expelled from the primary processing device it cools rapidly to form the additive material having a specific surface area of at least about 10 square centimeters per gram. The actual initial cooling rate upon expulsion from the primary processing device will depend upon the specific equipment and materials used, as well and the ambient environment, and should generally be greater than 10° C. per second.

The additive material may be formed into any one of a number of useful morphologies all being free of dusting problems. To facilitate dispersion of the additive material into an aqueous system, it is prefered to select processing conditions to obtain expelled additive material having a specific surface area of at least 50 square centimeters per gram, and more preferably at least 150 square centimeters per gram. To facilitate handling of the additive material, specific surface areas of from about 10 to about 200 square centimeters per gram are preferable. The selection of particular processing conditions, such as temperature and extruder slot sizes, to obtain a particular surface area for a particular additive composition are evident or readily determinable to one skilled in the art. The selection of a processing device also depends on the desired morphology of the cooled material (for example pellets or large flakes from an extruder versus fibers or small flakes from a floss machine).

After the additive material is prepared in this manner, it can easily be collected and stored for later addition to an aqueous medium, such as a silver halide emulsion or coating composition. When needed, the required amount of the additive material is simply added to the liquid surface of the emulsion or coating composition where it wets, and disperses and/or dissolves into the aqueous system.

The resulting silver halide emulsions and coating compositions can be coated onto a support such as a film, for example of cellulose acetate or polyethylene terephthalate, or paper, to form a photographic element. A discussion of suitable supports can be found in *Research Disclosure,* December 1989, Item No. 308119 and the references described therein. The photographic compositions can be coated on the support using, for example, the bead or curtain coating techniques as discussed in U.S. Pat. Nos. 2,761,417 to Russell et al., 2,681,294 to Beguin, 4,525,392 to Ishizaki, 3,632,374 to Greiller, and 4,569,863 to Koepke et al., the disclosures of which are incorporated herein by reference. The photographic element comprises at least one light-sensitive layer containing silver halide grains and, optionally, at least one other layer, at least one of the layers comprising a composition prepared from an emulsion or coating composition containing at least one hydrophobic, photographically useful compound incorporated therein in accordance with this invention.

The photographic element is preferably a multicolor element contain dye image-forming units sensitive to each of the three primary regions of the visible light spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like.

The support of the photographic element of this invention can be coated with a magnetic recording layer as discussed in Research Disclosure 34390 of November 1992, the disclosure of which is incorporated herein by reference.

In the following more detailed discussion of suitable materials for use in this invention, reference will be made to *Research Disclosure,* December 1978, Item 17643, and *Research Disclosure,* December 1989, Item No. 308119, both published by Kenneth Mason Publications, Ltd., Dudley Annex, 12a North Street, Emsworth, Hampshire PO10 7DQ, ENGLAND, the disclosures of which are incorporated herein by reference. These publications will be identified hereafter by the term "Research Disclosure." A reference to a particular section in "Research Disclosure" corresponds to the appropriate section in each of the above-identified *Research Disclosures.* The elements of the invention can comprise emulsions and addenda described in these publications and publications referenced in these publications.

The silver halide emulsions employed in this invention can be comprised of silver bromide, silver chloride, silver iodide, silver bromochloride, silver iodochloride, silver iodobromide, silver iodobromochloride or mixtures thereof. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al. U.S. Pat. No. 4,434,226, Daubendiek et al. U.S. Pat. No. 4,414,310, Wey U.S. Pat. No. 4,399,215, Solberg et al. U.S. Pat. No. 4,433,048, Mignot U.S. Pat. No. 4,386,156, Evans et al. U.S. Pat. No. 4,504,570, Maskasky U.S. Pat. 4,400,463, Wey et al.

U.S. Pat. No. 4,414,306, Maskasky U. S. Pat. Nos. 4,435, 501 and 4,643,966 and Daubendiek et al. U.S. Pat. Nos. 4,672,027 and 4,693,964, all of which are incorporated herein by reference. Also specifically contemplated are those silver iodobromide grains with a higher molar proportion of iodide in the core of the grain than in the periphery of the grain, such as those described in British Reference No. 1,027,146; Japanese Reference No. 54/48,521; U.S. Pat. Nos. 4,379,837; 4,444,877; 4,665,012; 4,686,178; 4,565, 778; 4,728,602; 4,668,614 and 4,636,461; and in European Reference No 264,954, all which are incorporated herein by reference. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface-sensitive emulsions, i.e., emulsions that form latent images primarily on the surface of the silver halide grains; or internal latent image-forming emulsions, i.e., emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface-sensitized, and noble metal (e.g., gold), middle chalcogen (e.g., sulfur, selenium, or tellurium) and reduction sensitizers, employed individually or in combination, are specifically contemplated. Typical chemical sensitizers are listed in *Research Disclosure*, Item 308119, cited above, Section III.

The silver halide emulsions can be spectrally sensitized with dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, stryryls, merostyryls, and streptocyoanines. Illustrative spectral sensitizing dyes are disclosed in *Research Disclosure,* Item 308119, cited above, Section IV.

Suitable vehicles for the emulsion layer and other layers of elements of this invention are described in *Research Disclosure,* Item 308119, Section IX and the publications cited therein.

The photographic multilayer color elements of this invention include couplers as described in Research Disclosure, Section VII, paragraphs D, E, F, and G and the publications cited therein. The couplers can be incorporated into a photographic composition in accordance with this invention or as described in Research Disclosure, Section VII, paragraph C, and the publications cited therein.

The photographic elements of this invention can contain brighteners (*Research Disclosure,* Section V), antifoggants and stabilizers (*Research Disclosure*, Section VI), antistain agents and image dye stabilizers *(Research Disclosure,* Section VII, paragraphs I and J), light absorbing and scattering materials (*Research Disclosure,* Section VIII), hardeners (*Research Disclosure,* Section X), coating aids (*Research Disclosure,* Section XI), plasticizers and lubricants (*Research Disclosure,* Section XII), antistatic agents (*Research Disclosure,* Section XIII), matting agents (*Research Disclosure,* Section XII and XVI) and development modifiers (*Research Disclosure,* Section XXI.

At least one of the couplers and/or additives is incorporated into a photographic emulsion or coating composition used to prepare the photographic element in accordance with this invention. Other couplers and/or additives are incorporated into photographic compositions for use in preparing the photographic element by any appropriate method, including, but not limited to, the methods discloses in the *Research Disclosures.*

The photographic elements of the invention can be exposed to actinic radiation, typically in the visible region of the spectrum, to form a latent image as described in *Research Disclosure,* Section XVIII, and then processed to form a visible dye image as described in *Research Disclosure,* Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N-(b-methanesulfonamidoethyl)-aniline sulfate hydrate, 4-amino-3-methyl-N-ethyl-N-(b-hydroxyethyl)-aniline sulfate, 4-amino-3-(b-methanesulfonamidoethyl)-N,N-diethylaniline hydrochloride, and 4-amino-N-ethyl-N-(b-methoxyethyl)-m-toluidine di-p-toluenesulfonic acid. With negative-working silver halide, the processing step described above provides a negative image. The described elements are preferably processed in the known C-41 color process as described in, for example, the British Journal of Photography Annual, 1988, pages 196–198. To provide a positive (or reversal) image, the color development step can be preceded by development with a non-chromogenic developing agent to develop exposed silver halide, but not from dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver or silver halide, washing, and drying.

The following examples illustrate the incorporation of hydrophobic photographically useful compounds into photographic composition.

Example 1

To observe the behavior of materials prepared by the method of this invention when added to an aqueous system, the following mixtures were created:

A. 2.0 grams spectral sensitizing dye "a" 10.0 grams E. Merck Karion® sorbitol 88.0 grams Hubinger Dry-Sweet® maltodextrin (dextrose equivalent of 42) Structure of dye "a":

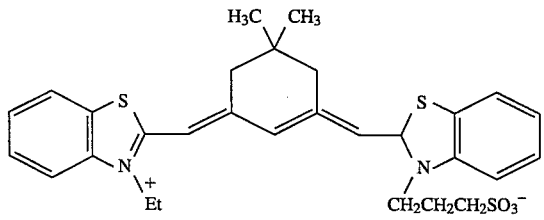

B. 1.0 grams spectral sensitizing dye "a" 99.0 grams Hubinger Dry-Sweet® maltodextrin (dextrose equivalent of 42)

C. 2.0 grams spectral sensitizing dye "b" 10.0 grams E. Merck Karion® sorbitol 88.0 grams Hubinger Dry-Sweet® maltodextrin (dextrose equivalent of 42) Structure of dye "b":

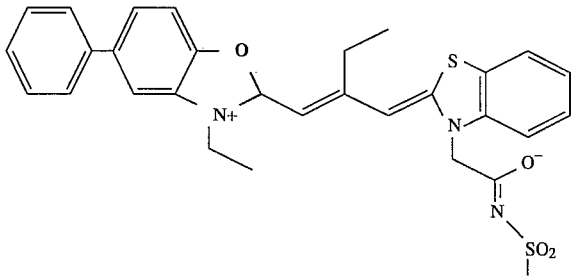

D. 2.0 grams spectral sensitizing dye "c" 20.0 grams Eastman succinimide 78.0 grams Hubinger Dry-Sweet® maltodextrin (dextrose equivalent of 42) Structure of dye "c":

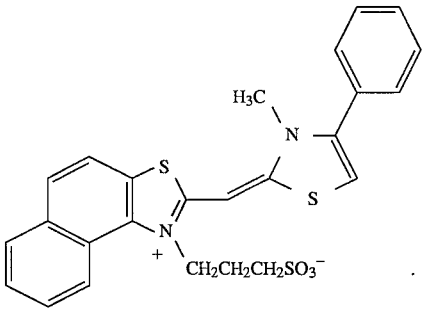

Each mixture above was blended dry using a Teledyne-Readco CB-M powder mixer for 5 minutes. Mixtures A, C, and D were then separately added via an Accurate powder feeder at approximately 4 grams/minute to a modified Gold Medal Products Whirlwind® floss spinning machine. The floss machine was specially modified to allow precise control of the operating temperature and rotation speed. The machine was run at 3000 rpm and at a temperature of 140° C. The resulting processed materials were semi-transparent and in the form of thin colored fibers having an estimated specific surface area of greater than 150 square centimeters per gram based upon photomicrographs of the fibers.

Mixture B was fed by an AccuRate powder feeder into the inlet of a single screw extruder (0.75 inch× 30 inches) fitted with a heated die that produces a flat sheet approximately 3 inches in width and 1/32 inch in thickness. The extruder sections were operated at a temperature of 140° C. Once the material exited the die, it cooled very rapidly and the resulting brittle sheet broke apart under its own weight into small shards. The shards ranged in size from one inch across to small fragments of a few hundredths of an inch. The material was transparent, and had an estimated specific surface area of greater than 50 square centimeters per gram.

Each of the materials prepared above (A through D) was separately added to 250 grams of a five weight percent gelatin solution at 45° C. and with moderate agitation (using a one-inch magnetic stirring bar at 300 rpm). The amount added in each case was equivalent to 0.2 grams of dye. For comparison, 0.2 grams of each dye was separately added as a dry powder to the same quantity of gelatin at the same temperature and level of agitation. The behavior of the dye or dye bearing material when added to the gelatin is summarized in Table 1 below:

TABLE 1

| Material | Amount Added | Observations |
|---|---|---|
| Dye "a" | 0.2 g | After 20 sec. nearly all of dye below liquid surface, gelatin solution gradually became dark blue with 1 to 5 mm dye clumps. |
| Material A | 10.0 g | Material quickly (<5 sec.) wet and sank below liquid surface, much smaller dye flecks in solution compared with dye alone. Solution darker in color than dye added alone. |
| Material B | 20.0 g | All of material below liquid surface in <5 sec., fine flecks of dye as with material A. Darkest solution color of the three. |
| Dye "b" | 0.2 g | After 20 sec., some 1 to 5 mm clumps appear below liquid surface, after 1 min., approximately half of dye remains on liquid surface. Most of dye below surface after 12 minutes, solution opaque pink with iridescent flecks, sheen of dye on liquid surface. |
| Material C | 10.0 g | All of the mixture was below surface in <5 sec., bulk appearance similar to dye alone but no dye sheen (accumulation) on liquid surface. |
| Dye "c" | 0.2 g | After 20 sec., approx. half of dye remains on liquid surface, after 1 min., most below surface. Solution was opaque yellow with some 1 to 5 mm dye clumps, fine platelets of dye on liquid surface after 5 minutes. |
| Material D | 0.2 g | All of the material was below surface in <5 sec., no change in appearance after 45 sec. Solution was opaque yellow, no dye observed on liquid surface. |

As can be seen from the above example, the materials prepared by the process of this invention result in more rapid wetting and dispersal of the hydrophobic spectral sensitizing dye in gelatin compared with adding the dye directly. This improvement is accomplished without the need to use volatile organic solvents with the accompanying problems they cause.

Example 2

Material Preparation:

The following mixture was prepared using a mortar and pestle and blended by hand for approximately 10 minutes:

5.0 grams spectral sensitizing dye "a" (shown in previous example)

95.0 grams Grain Process Corp. Maltrin® 365 maltodextrin (36 dextrose equivalent)

This mixture was then added to a Gold Medal Products Econofloss® floss spinning machine operating at 3600 rpm and a temperature of approximately 150° C. The resulting material was semi-transparent and in the form of approximately 0.5 cm flakes (average diameter) having an estimated specific surface area of greater than 50 square centimeters per gram.

Coating and Evaluation:

In example 2, part 1, an emulsion comprising 2.5 moles of AgClBr (25% bromide) substrate of cubic edge length 0.15 mm, that had been precipitated in gelatin from the double-jet reaction of silver nitrate and sodium halide, is finished as per the following sensitization profile:

While maintaining the emulsion temperature at 43.3° C., 7.25 mg sodium thiosulfate pentahydrate is added.

After 2 minutes, 12.2 mg sodium aurousdithiosulfate dihydrate is added.

After 2 additional minutes, 2.18 mg bis(2-amino-5-iodopyridine-dihydroiodide) mercuric iodide is added.

After 2 additional minutes, 375 mg dye "a" as a 0.21 wt. % methanol solution is added.

After 20 additional minutes, 43.8 mg 4-carboxymethyl-4-thiazoline-2-thione is added. The emulsion temperature is then maintained at 43.3° C. for an additional 1 minute, and then ramped up to 71.1° C. over a period of 17 minutes. The temperature is then maintained at 71.1° C. for 5 minutes, and then ramped down to a temperature of 46.1° C. over a period of 22 minutes.

While maintaining the temperature of the emulsion at 46.1° C., 2125 mg 4,4'-bis ((4,6-bis-p-chloroaniline-s-triazine-2-yl) amino)-2,2'stilbene disulfonic acid disodium salt is then added.

After 5 more minutes, 710 mg 3-methyl-1,3-benzothiazolium iodide is added.

After 5 additional minutes, 4750 mg 5-methyl-s-triazole-(2-3-a)-pyrimidine-7-ol sodium salt is added.

After 5 additional minutes, 650 mg 2-mercapto-1,3-benzothiazole is added.

Portions of the emulsion sensitized as described above were coated on transparent film support, along with additional gelatin, a color-forming organic coupling compound or compounds, appropriate surfactants, and a hardening agent for the gelatin. This photographic element was then dried and exposed for 0.002 seconds to light by means of a 3000K tungsten light source through a tablet consisting of steps with 0.15 optical density increments, in order to provide 0.15 incremental log(exposure) latent images in the photographic element.

The thus exposed photographic element was then developed for times ranging from one to five minutes (usually three minutes) at about 35° C. in a solution consisting of one of the standard color developing agents, well known in photographic laboratories, followed by an appropriate acidic solution to terminate the development reaction then followed by one of the standard bleach solutions and finally by a fixer solution containing sodium thiosulfate ("hypo").

The thus developed, bleached, and fixed photographic element was again dried and the optical densities due to dye formation, if any, were measured in one of the many densitometers well known in photographic laboratories using a filter in the densitometer appropriate to the intended use of the photographic element.

Dye density was then graphed versus log(exposure) to form the-so-called characteristic curve of the photographic element. The relative photographic sensitivity at the predetermined density of 1.0 was measured from the end of the log(exposure) scale which represents the greatest exposure to the photographic element. When the characteristic curve passes through a density equal to 1.0 farther from the end of the log(exposure) scale which represents the greatest exposure, then that photographic element is considered to be faster in speed or higher in relative photographic sensitivity.

In example 2 part 2, the same sensitization, coating, exposure, and developing steps are repeated except in place of the methanol solution of dye "a", the same quantity of dye "a" is added as a dry solid to the emulsion. In example 2 part 3, the same steps as in example 2, part 1 are repeated except 7500 mg of the dye "a"-maltodextrin material (containing 375 mg of dye "a") described above was used in place of the methanol solution of dye "a". The resulting relative speed values observed are shown in Table 2.

TABLE 2

| Example 2 part | Relative Speed |
|---|---|
| 1 (comparison) | 147 |
| 2 (control) | 80 |
| 3 (invention) | 130 |

From Table 2, it can be seen that the dye-maltodextrin material in part 3 is far superior to the dry dye alone (part 2) and approaches the relative speed of the methanol solution of dye "a" (part 1).

Example 3

Material Preparation:

A dry mixture (A) of the following compounds was blended together using a Teledyne-Readco powder mixer for 5 minutes:

0.5 grams p-acetamidophenyl disulfide 99.5 grams Pfizer Litesse® polydextrose

This mixture was then added via an Accurate powder feeder at approximately 4 grams/minute to a modified Gold Medal Products Whirlwind® floss spinning machine. The floss machine was specially modified to allow precise control of the operating temperature and rotation speed. The machine was run at 2000 rpm and a temperature of 140° C. The resulting processed material was semi-transparent and in the form of thin tan-colored fibers having an estimated specific surface area of greater than 150 square centimeters per gram.

A second mixture (B) of the following compounds was blended together as described above for mixture A:

0.5 grams p-acetamidophenyl disulfide 89.5 grams Hubinger Dry-Sweet® maltodextrin (dextrose equivalent of 42)

10.0 grams E. Merck Karion® sorbitol

As with mixture A above, this mixture was processed using the same equipment and conditions. The sorbitol in mixture B was added to increase the processing rate through the floss spinning machine and also to prevent discoloration (decomposition) of the maltodextrin. The resulting material was semi-transparent and in the form of thin white fibers having an estimated specific surface area of greater than 150 square centimeters per gram.

Coating and Evaluation:

A 0.61 mm×0.1 mm 4.0% iodide, silver bromoiodide tabular emulsion was sensitized with conventional sulfur and gold compounds and cyan thiacarbocyanine dyes and with 31 mg of N-methylsulfamoylethyl benzothiazolium tetrafluoroborate per silver mole by holding at 63° C. for 15 minutes. The sensitized emulsion was then divided into twelve parts and varying amounts of p-acetamidophenyl disulfide (0.15, 0.60 and 2.4 millimoles per silver mol) was added as a 3.38 grams/liter methanol solution, material mixture A, and material mixture B. In addition, three parts were left without addition of the p-acetamidophenyl disulfide as controls for comparison.

A secondary composition was prepared consisting of gelatin solution, 2-[2,4-bis(1,1-dimethylpropyl)phenoxy]-N-{4-[(2,2,3,3,4,4,4-heptafluoro-1-oxobutyl)amino]-3-hydroxyphenyl}-hexanamide, and coating surfactants was mixed in equal volumes with the emulsion finished as described above immediately before coating on a cellulose acetate support. This layer was then protected by a gelatin overcoat and hardened.

The resulting dried coatings containing 75 mg of silver per square foot, 220 mg of gelatin per square foot, and 144 mg of 2-[2,4-bis(1,1dimethylpropyl)phenoxy]-N-{4-[(2,2,3,3,4,4,4-heptafluoro- 1-oxobutyl)amino]-3-hydroxyphenyl}-hexanamide per square foot were exposed for 0.02 seconds through a stepped density tablet and 0.3 density Inconel and Kodak Wratten 23A with 5500 K light. Exposed strips were then developed in either E-6 color reversal developer to form positive color images from which Dmax (maximum density) and speed at 0.3 below Dmax were obtained or a negative-working development using a variation of the E-6 process (rehalo) to form negative color images from which fog and speed at a point density above Dmin were obtained. Low fog from E-6 rehalo and high Dmax from E-6 indicate activity from the p-acetamidophenyl disulfide as discussed in U.S. Pat. No. 5,217,859.

The analysis of exposed strips are shown in Table 3:

TABLE 3

| P-Acetamido-phenyl Disulfide Addition Method | Amount mmol/Ag mol | Rehalo Dmin | Rehalo speed | E-6 Dmax | E-6 speed |
|---|---|---|---|---|---|
| Control (no addition) | 0 | 0.504 | 191 | 2.36 | 186 |
| Control (no addition) | 0 | 0.487 | 194 | 2.37 | 192 |
| Control (no addition) | 0 | 0.505 | 192 | 2.33 | 192 |
| Methanol Solution | 0.15 | 0.297 | 177 | 2.51 | 173 |
| Methanol Solution | 0.60 | 0.165 | 183 | 2.69 | 182 |
| Methanol Solution | 2.40 | 0.138 | 174 | 2.69 | 170 |
| In Polydextrose | 0.15 | 0.344 | 193 | 2.45 | 189 |
| " | 0.60 | 0.238 | 181 | 2.61 | 182 |
| " | 2.40 | 0.191 | 185 | 2.54 | 180 |
| In Maltodextrin | 0.15 | 0.286 | 185 | 2.53 | 184 |
| " | 0.60 | 0.215 | 185 | 2.56 | 180 |
| " | 2.40 | 0.181 | 185 | 2.51 | 178 |

It can be seen from Table 3 that the p-acetamidophenyl disulfide is nearly equally effective in reducing Dmin relative to the control when added as either a methanol solution or as a solid material combined with either polydextrose or maltodextrin/sorbitol.

Example 4

Pure silver chloride was precipitated by a double jet technique with the use of 1.8-dithiaoctanediol as a growth ripener. The resulting cubic emulsion had an edge length of 0.75 mm. Gold sulfide was added to this emulsion and then heated at elevated temperature for 65 minutes in the presence of a cyanine yellow sensitizing dye, 1-(3-acetamidophenyl)-5-mercaptotetrazole, and potassium bromide. This sensitized emulsion is the control emulsion, Emulsion "A". Immediately prior to coating, the emulsions were co-mixed with a yellow image coupler dispersion which was stabilized with benzenesulfonic acid. The co-mixture of Emulsion "A" and coupler dispersion was designated Part 1. To 0.011 Ag mol of Emulsion "A" was added 1.78 g of Pfizer Litesse® polydextrose (160 g/Ag mol), then co-mixed with coupler dispersion (designated Part 2). To another 0.011 Ag mol portion of Emulsion "A" was added 1.78 g of a mixture of 90% Hubinger Dry-Sweet® maltodextrin and 10% E. Merck Karion® sorbitol (160 g mixture/Ag mol), then co-mixed with coupler dispersion (designated Part 3). To another 0.011 Ag mol portion of Emulsion "A" was added 1.78 g of material mixture A (from Example 3) (yields 800 mg or 2.4 mmol of p-acetamidophenyl disulfide per Ag mol), then co-mixed with coupler dispersion (designated Part 4). To another 0.011 Ag mol portion of Emulsion "A" was added 1.78 g of material mixture B (from Example 3) (yields 800 mg or 2.4 mmol of p-acetamidophenyl disulfide per Ag mol), then co-mixed with coupler dispersion (designated Part 5). All liquid silver chloride mixtures were coated on resin coated paper support to give 26 mg silver, 100 mg yellow coupler, and 77 mg gelatin per square foot. Dried coatings were subjected to a sensitometric gradation exposure of 0.1 second through a set of Kodak filters. The rapid access RA-4 process was used as described in Research Disclosure, Vol. 308, p. 933, 1989. Speeds are measured at 1.0 density. Loss of speed in this emulsion composition indicates expected activity from the p-acetamidophenyl disulfide.

TABLE 4

| Part | Speed | Dmin | Comments |
|---|---|---|---|
| 1 | 156 | 0.06 | control, no sugar |
| 2 | 157 | 0.07 | polydextrose only |
| 3 | 156 | 0.07 | maltodextrin/sorbitol only |
| 4 | 147 | 0.06 | disulfide in polydextrose |
| 5 | 146 | 0.06 | disulfide in-maltodextrin/sorbitol |

The results in Table 4 show that the expected photographic effect is seen from the disulfide whether introduced as a solid material composition with either polydextrose or maltodextrin/sorbitol. High temperature incubations of these emulsion coatings also showed the beneficial stabilization of speed and fog attributed to the disulfide, but coatings containing polydextrose or maltodextrin/sorbitol only were indistinguishable from the control with no added saccharide. The effects seen from adding disulfide as a solid material composition with either polydextrose or maltodextrin/sorbitol were comparable to those seen when the disulfide was added from a methanolic solution.

The invention has been described in detail with particular reference to preferred embodiments thereof, but it is to be understood that variations and modifications can be effected within the spirit and scope of the invention.

What is claimed is:

1. A method for incorporating a solid hydrophobic photographically useful compound into an aqueous photographic composition which comprises:

(a) mixing particles of the photographically useful compound with particles of a hydrophilic solid material;

(b) heating the resulting mixture in a primary processing device to at least the softening point of the mixture, and expelling the heated mixture directly from the primary processing device to rapidly cool the mixture and to thereby directly form a solid additive material having a specific surface area of at least about 10 square centimeters per gram; and (c) adding the solid additive material directly into the aqueous photographic composition.

2. A method according to claim 1, wherein the photographically useful compound is selected from the group consisting of: spectral sensitizing dyes, absorbing dyes, antifoggants, antioxidants, nucleating agents, biostats, biocides, antifoamants, development accelerators, emulsion finish modifiers, image toners, optical brighteners, couplers, antistain agents, hardeners, storage stabilizers, and latent image stabilizers.

3. A method according to claim 2, wherein the photographically useful compound is a sensitizing dye.

4. A method according to claim 3 wherein the sensitizing dye is selected from sensitizing dyes having the structural formulae

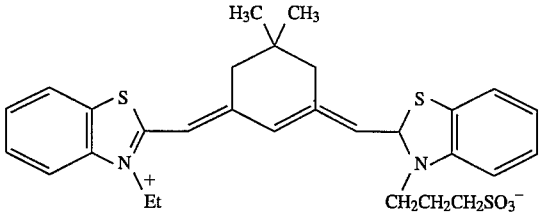

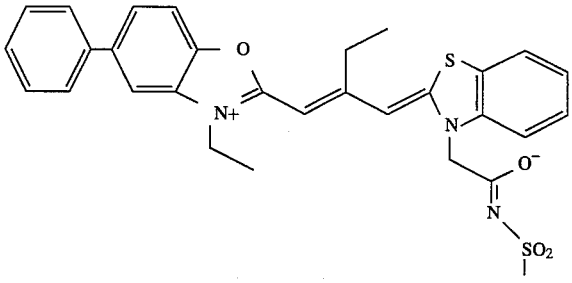

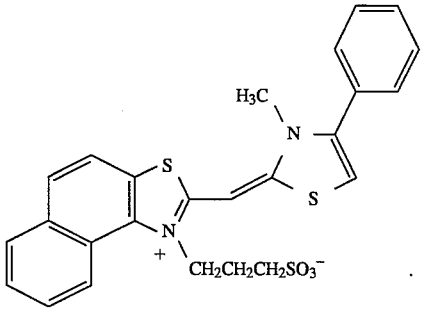

5. A method according to claim 1, wherein the hydrophilic solid material comprises a water soluble polymer.

6. A method according to claim 5, wherein the resulting mixture is heated to a temperature of from 70 to 200° C. in step (b).

7. A method according to claim 5, wherein the water soluble polymer is a polysaccharide, polyvinyl alcohol, polyacrylamide, cellulose derivatives, polyoxyethylene, gelatin, vegetable gum, polyacrylic acid, polyvinyl pyrrolidone, partially hydrolzed polyvinyl acetate, and derivatives or copolymers of these.

8. A method according to claim 7 wherein the water soluble polymer is a polysaccharide.

9. A method according to claim 8, wherein the polysaccharide is maltodextrin.

10. A method according to claim 5, wherein the hydrophilic solid material further comprises a second component comprising a water soluble low molecular weight material which has a melting point between about 30° and about 200° C.

11. A method according to claim 10, wherein said second component is selected from the group consisting of: derivatives of urea and thiourea of the formula

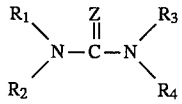

wherein $R_1$, $R_2$, $R_3$ and $R_4$ each independently represent alkyl having 1 to 4 carbon atoms, which may be substituted by hydroxyl, cycloalkyl or phenyl; or tolyl, which may be substituted with hydroxyl groups; and wherein $R_1$, $R_2$ , and $R_3$ can also be hydrogen; and Z represents oxygen or sulphur; saturated and unsaturated mono and dicarboxylic acid amides; lactams; acid imides; oximes; saturated and unsaturated 5- or 6-membered heterocyclic compounds; polyvalent alcohols; polyalkylene glycols; carbamic acid esters; and derivatives of benzene of the formula

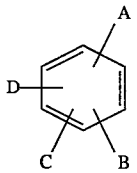

wherein A, B, C and D each independently represent OH, halogen, alkyl, hydroxyalkyl and alkoxy having 1 to 3 carbon atoms; and wherein A, B and C can be hydrogen.

12. A method according to claim 10, wherein the second component comprises sorbitol or succinimide.

13. A method according to claim 1, wherein the hydrophilic solid material comprises maltodextrin and either of sorbitol or succinimide.

14. A method according to claim 1, wherein the primary processing device is an extruder.

15. A method according to claim 1, wherein the primary processing device is a melt spinning device.

16. A method according to claim 15, wherein the solid additive material formed in step (b) is in the shape of thin fibers having a specific surface area of at least about 150 square centimeters per gram.

17. A method according to claim 1, wherein the solid additive material formed in step (b) has a specific surface area of from about 10 to about 200 square centimeters per gram.

18. A photographic element comprising a support having coated thereon at least one layer comprising a photographic composition containing a hydrophobic photographically useful compound incorporated into the composition by the method of claim 1.

19. A method for incorporating a solid hydrophobic compound into an aqueous medium which comprises:

(a) mixing particles of the hydrophobic compound with particles of a hydrophilic solid material comprising a water soluble polymer and a water soluble low molecular weight compound having a melting point between about 30° C. and about 200° C.;

(b) heating the resulting mixture in a primary processing device to at least the softening point of the mixture, and expelling the heated mixture directly from the primary processing device to rapidly cool the mixture and to thereby directly form a solid additive material having a specific surface area of at least about 10 square centimeters per gram; and (c) adding the solid additive material directly into the aqueous medium.

20. A method according to claim 19 wherein the water soluble polymer is a polysaccharide.

21. A method according to claim 20, wherein the polysaccharide is maltodextrin.

22. A method according to claim 20, wherein the low molecular weight compound is selected from the group consisting of derivatives of urea and thiourea of the formula

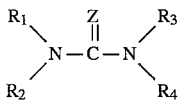

wherein $R_1$, $R_2$, $R_3$ and $R_4$ each independently represent alkyl having 1 to 4 carbon atoms, which may be substituted by hydroxyl, cycloalkyl or phenyl; or tolyl, which may be substituted with hydroxyl groups; and wherein $R_1$, $R_2$ and $R_3$ can also be hydrogen; and Z represents oxygen or sulphur; saturated and unsaturated mono and dicarboxylic acid amides; lactams; acid imides; oximes; saturated and unsaturated 5- or 6-membered heterocyclic compounds; polyvalent alcohols; polyalkylene glycols; carbamic acid esters; and derivatives of benzene of the formula

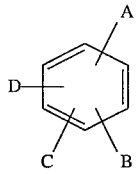

wherein A, B, C and D each independently represent OH, halogen, alkyl, hydroxyalkyl and alkoxy having 1 to 3 carbon atoms; and wherein A, B and C can be hydrogen.

23. A method according to claim 22, wherein the low molecular weight compound comprises sorbitol or succinimide.

24. A method according to claim 22, wherein the primary processing device is a melt spinning device.

25. A method according to claim 24, wherein the solid additive material formed in step (b) is in the shape of thin fibers having a specific surface area of at least about 150 square centimeters per gram.

26. A method according to claim 19, wherein the solid additive material formed in step (b) has a specific surface area of from about 10 to about 200 square centimeters per gram.

* * * * *